United States Patent [19]

Heimnick

[11] Patent Number: 4,505,237

[45] Date of Patent: Mar. 19, 1985

[54] VACUUM CONTROL DEVICE

[75] Inventor: Paul Heimnick, Owosso, Mich.

[73] Assignee: Schmelzer Corporation, Flint, Mich.

[21] Appl. No.: 483,259

[22] Filed: Apr. 8, 1983

[51] Int. Cl.[3] ..... F02M 1/14

[52] U.S. Cl. ..... 123/179 G

[58] Field of Search ..... 123/179 G, 179 B, 179 BG, 123/398, 401; 261/64 R, 64 C, 64 E, 64 B, 65, DIG. 18, DIG. 19, DIG. 74

[56] References Cited

U.S. PATENT DOCUMENTS

| | | | |
|---|---|---|---|
| 4,060,063 | 11/1977 | Hirasawa | 261/DIG. 19 |
| 4,168,680 | 9/1979 | Kawai et al. | 261/DIG. 19 |
| 4,186,697 | 2/1980 | Yasuda et al. | 123/179 G |

FOREIGN PATENT DOCUMENTS

| | | | |
|---|---|---|---|
| 54-36431 | 3/1979 | Japan | 261/DIG. 19 |

*Primary Examiner*—William A. Cuchlinski, Jr.
*Attorney, Agent, or Firm*—Harness, Dickey & Pierce

[57] ABSTRACT

A control device for use in an air induction system of an internal combustion engine having a spark ignition system for maintaining a vacuum operated device actuated once the engine has started independently of fluctuations in vacuum pressure in which the device has a housing with chambers communicating with a source of vacuum and with the device to be operated and in which fluid communication between the chambers is regulated by a first valve operated in response to energization and de-energization of the ignition system and a second valve which permits fluid flow from the device to be actuated through the source of vacuum pressure but prevents fluid flow in the opposite direction.

12 Claims, 3 Drawing Figures

VACUUM CONTROL DEVICE

This invention relates to engine control devices and more particularly to vacuum control devices for use with internal combustion engine fuel-air systems.

The engine intake manifold of internal combustion engines is used as a source of vacuum pressure for various vacuum control devices. Unfortunately, such a source is variable and becomes minimal or non-existent whenever the engine is given full throttle. This interrupts the effective operations of devices which require some predetermined, uniform level of vacuum pressure.

An example of a vacuum operated device in association with an internal combustion engine is a vacuum break which is actuated at a delayed rate to move the carburetor choke valve to an open position as soon as the engine starts to prevent delivery of a rich mixture of fuel and consequent flooding of the engine. Such vacuum break devices are required at the time of engine start up and before the engine achieves normal operating temperatures. However, rapid acceleration of an engine severely reduces the vacuum level required to operate the vacuum break and if the engine is cold, the vacuum break will return to its initial position thereby closing the choke valve which restricts the delivery of air to the carburetor and prevents engine acceleration. Still other devices are employed with the intake manifold as a vacuum source such as exhaust gas recirculating systems.

It is desirable to have an is an object of the invention to provide a means for maintaining a predetermined level of vacuum pressure at a vacuum operated device so that the device remains operated during a temporary loss of reduction of the source of vacuum pressure.

The invention contemplates a control device for an internal combustion engine having a spark ignition system and a source of vacuum pressure in which the control device is connected between a vacuum source and a vacuum operated device such as a vacuum break. The control device includes a housing having a wall within the housing forming chambers at opposite sides which communicate with the source of vacuum and with the vacuum break, respectively. An open valve seat is formed in the wall and soon as the ignition system is energized, a motor means is actuated to close the valve seat. A one-way check valve also is formed in the wall to permit air flow from the vacuum operated device, such as the vacuum break, to the source of vacuum, such as the manifold of the internal combustion engine, but prevents air flow in the opposite direction so that the vacuum actuated device is isolated once it has been energized for the period of time that the motor means is energized which is for the entire period of operation of the internal combustion engine.

A preferred embodiment of the invention is illustrated in the drawings in which.

Figure 1:
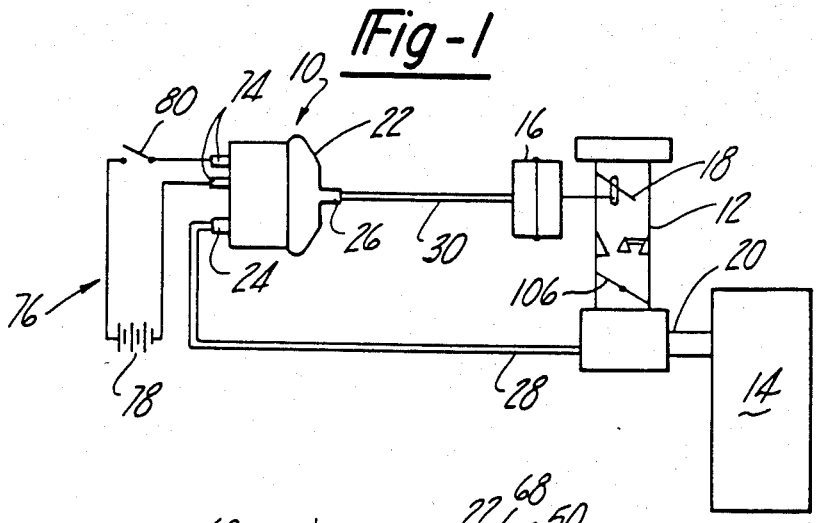
FIG. 1 is a diagrammatic view of the control device embodying the invention shown in association with various components of an internal combustion engine and its fuel-air system.

The valve assembly embodying the invention is designated generally at 10 and is illustrated in FIG. 1 in association with an air induction system including a carburetor 12 for an internal combustion engine 14. The carburetor 12 is under the control of a device in the form of a vacuum break 16 which is connected to a choke valve 18 so that upon starting of the engine 14, the vacuum break 16 operates in response to vacuum pressure from a source such as the intake manifold 20 of the engine 14 to move the choke valve 18 to an open position so that the engine is not flooded with fuel.

The valve assembly 10 is made up of a housing 22 which is provided with an inlet port 24 and an outlet port 26. The inlet port 24 is connected to the manifold 20 by a vacuum line 28 and the outlet port 26 is connected to the vacuum break 16 by a vacuum line 30.

Figure 2:
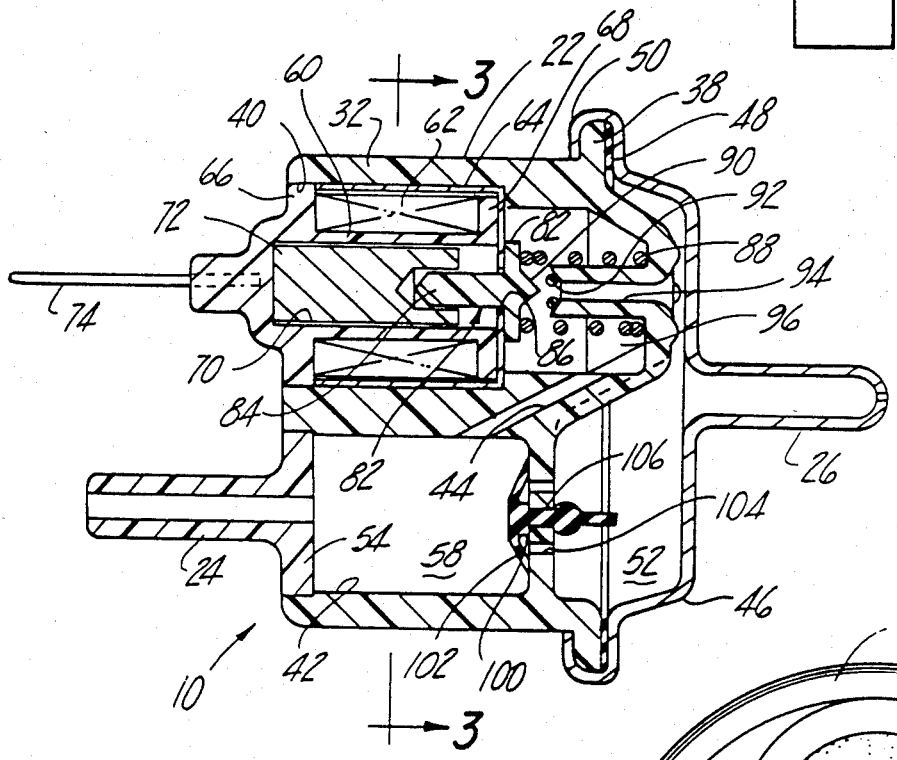
FIG. 2 is a cross-sectional view at an enlarged scale of the control device seen in FIG. 1.
Figure 3:
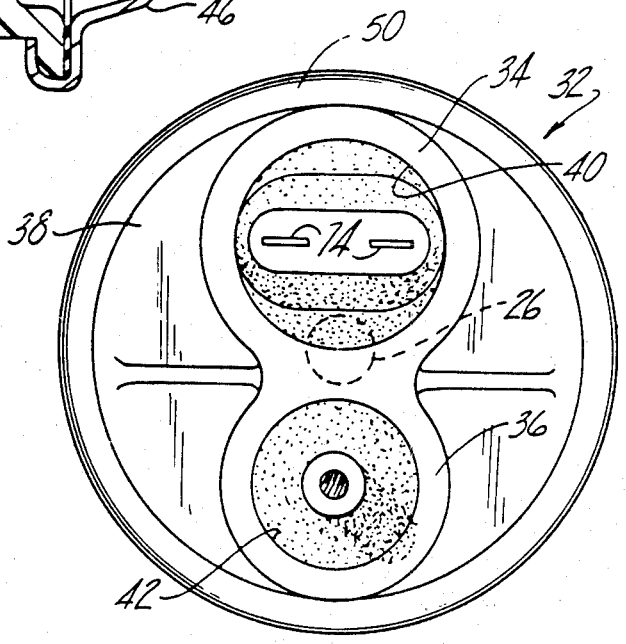
FIG. 3 is an end view from one end of the device in FIG. 2.

The housing 22 is made of plastic material and as seen in FIG. 3, a body member 32 of irregular shape having a pair of generally cylindrical body portions 34 and 36 which are joined integrally together to extend from one side of a disc-shaped flange 38. The body portions 34 and 36 form a pair of cylindrical bores 40 and 42, respectively, disposed in parallel relationship to each other and interconnected by an angularly disposed passage 44, which as seen in FIG. 2, maintains the bores 40 and 42 in continuous communication with each other.

The housing 22 also has a cover plate 46 which may be made of metal and forms the tubular outlet 26. The cover plate 46 is held in sealed engagement with the flange 38 through means of a gasket 48 and a bead 50 which holds the cover plate 46 assembled to the body member 32. One side of the disc 38 forms a wall which acts together with the cover plate 46 to form a chamber 52 communicating with the outlet 26.

The end of bore 42 is closed by a plug 54 having a stem forming the inlet 24. The plug 54 is held in fixed position at the end of the bore 42 by means of sonic welding or the like which fuses and seals the plug 54 to the walls of the bore 42 and forms a chamber 58.

The bore 40 is closed by one end of a spool 60 which forms the support for a wire coil 62. The spool 60 is disposed in a metal, cup-shaped liner 64. One flange 66 of the spool 60 closes the end of the bore 40 and is fused thereto to seal the bore 40. The other end of spool 60 is provided with a flange 68 seated against the bottom of the metal liner 64. Spool 60 has a hollow core 70 which receives a slidable armature 72 such that upon energization of the coil 62, illustrated in FIG. 2, the armature 72 moves toward the right. The coil 62 is electrically connected to a pair of contacts 74 in a DC circuit 76 including a battery 78 and an ignition switch 80.

The end of armature 72 is fitted with a valve element 82 having a stem 84 passing through an opening 86 in the bottom of metal liner 64. The valve element 82 is biased to the position see in FIG. 2 by a return spring 88. The face of the valve element 82 is provided with a conical valve closure portion 90 which is adapted to move into engagement and close an opening in an O-ring 92 forming a valve seat communicating through a passage 94 leading to the chamber 52 and to the outlet 26. The end of the bore 40 forms opposite spool 60 forms an annular chamber 96 around the exterior of the projection forming the passage 94.

The chamber 58 formed within the bore 42 is provided with an umbrella-type valve element 100 having a flexible head 102 normally closing a plurality of apertures 104 formed in a wall at the bottom of the bore 42. The umbrella valve 100 has a stem 106 pressed into an opening and supporting the umbrella valve 100 responds to differential of pressures acts as a one-way valve permitting fluid flow from the chamber 52 to the chamber 58 but preventing fluid flow in the opposite direction.

The various parts of the control device 10 occupy the position seen in FIG. 2 when the engine 14 is not operating. Upon closing the ignition switch 80 in preparation for starting the engine 14, the coil 62 is energized causing the armature 72 to move to the right carrying with it the valve element 82 and acting to seat the closure portion 90 in the opening in O-ring seat 92. This closes the passage 94 to fluid flow in either direction. After the ignition switch 80 is closed and the engine 14 is started, vacuum pressure is created at the manifold 20 which is transmitted through the line 28 to the inlet 24 and to the chamber 58. Because of the differential in pressure in the chamber 58 and 52, the head 102 of the umbrella valve 100 lifts permitting fluid passage through apertures 104 from the chamber 52 to chamber 58 and to the outlet 26. This evacuates the line 30 to the vacuum break 16 which acts in response to vacuum pressure to open the choke valve 18, usually after a slight delay following starting of the engine which is characteristic of the vacuum break device 16.

In the event that the supply of vacuum pressure at the manifold 20 diminishes to some level below normal, as would occur upon full opening of the throttle 106, the vacuum level in line 28 and in chamber 58 will be substantially reduced. However, the pressure in chamber 58 will be higher than the vacuum pressure in chamber 52 and the umbrella valve 100 will remain in its closed position closing the apertures 104. This serves to trap vacuum pressure in the line 30 and in the vacuum break 16 so that the latter device remains in its actuated position to hold the choke valve 18 in its open position. It is for this reason that the device 10 frequently is referred to as a vacuum lock.

Once the vacuum break 16 has been actuated, it will remain in its actuated position even though the vacuum levels fluctuate so long as the engine continues to operate. However, upon opening the ignition switch 80 to stop the engine 14, the coil 62 becomes de-energized and the return spring 88 causes the armature 72 to return to the left as viewed in FIG. 2 to its initial position. This serves to open the opening in O-ring 92 permitting fluid communication between the vacuum break 16, outlet 26, chamber 52 and ultimately to chamber 58 through inlet 24 and line 28 to the manifold 20. This results in the establishing of atmosphere pressure in this entire circuit permitting the vacuum break 16 to return to its original inactive position in which the choke valve 18 is free to move to its closed position except for whatever interference may be imposed by other control devices such as bi-metal automatic choke control devices which are commonly used with engines.

A control device in the form of a vacuum lock has been provided in which vacuum actuated devices requiring the presence of vacuum pressure for operation are maintained in their activated position even though the vacuum pressure of the source is reduced below normal levels, for example, during acceleration of a vehicle and which permits such vacuum actuated devices to return to their normal, non-operating position when the engine is turned off. The control device insures that the actuated device remains in its actuated condition so long as the engine is operating. This has been accomplished by making the control device operable in response to energization of the ignition switch which closes a two-way valve to insure that all subsequent fluid flow is through a one-way valve.

The embodiments of the invention in which an exclusive property or privilege is claimed are defined as follows:

1. A control device for an internal combustion engine having a spark ignition system, a vacuum source, and a vacuum operated device, comprising: a housing including an inlet port adapted for connection to a vacuum source and an outlet port adapted for connection to a vacuum operated device, a wall in said housing forming chambers at opposite sides communicating with said inlet and outlet ports, respectively, a valve seat formed in said wall, motor means responsive to energization of said spark ignition system to close said valve seat and responsive to de-energization to open said valve seat, a one way valve in said wall between said chambers permitting fluid flow from said outlet port to said inlet port in the presence of vacuum pressure at said inlet port and preventing fluid flow in the opposite direction through said valve means, said valve seat remaining closed during energization of said spark ignition system to isolate said outlet port from said inlet port and maintain vacuum pressure at said vacuum operated device once the latter has been actuated.

2. The control device of claim 1 wherein said motor means includes a coil and a movable armature having a closure engageable with said valve seat.

3. The control device of claim 2 wherein said valve seat is formed by an O-ring.

4. The control device of claim 1 wherein said one-way valve includes a flexible closure portion responsive to fluid pressure differential at opposite sides of said wall to move to opened and closed positions.

5. In an internal combustion engine having a spark ignition system and an induction system for supplying a mixture of air and fuel in an intake manifold of the engine, a choke valve in said air induction system and a vacuum break responsive to vacuum at said intake manifold to move said choke valve to an open position, the combination comprising: a housing including an inlet port adapted for connection to said intake manifold and an outlet port adapted for connection to said vacuum break, a wall in said housing forming chambers at opposite sides communicating with said inlet and outlet ports, respectively, a valve seat formed in said wall, motor means responsive to energization of said spark ignition system to close said valve seat and being responsive to de-energization of said spark ignition system to open said valve seat, a one-way check valve in said wall between said chambers permitting fluid flow from said outlet port to said inlet port in the presence of vacuum pressure at said inlet port and preventing fluid flow in the opposite direction through said valve means, said valve seat remaining closed during energization of said spark ignition system to isolate said vacuum break from said manifold and maintain vacuum pressure at said vacuum break once the latter has been actuated during variations of vacuum pressure at said manifold and until said spark ignition system is deenergized.

6. The control device of claim 5 wherein said motor means includes a coil and a movable armature having a closure engageable with said valve seat.

7. The control device of claim 6 wherein said valve seat is formed by an O-ring.

8. The control device of claim 5 wherein the chamber communicating with said inlet port is formed by a pair of subchambers communicating with each other and wherein said valve seat is formed in one of said subchambers and said one-way valve is formed in the other of said subchambers.

9. The control device of claim 5 wherein said one-way valve includes a flexible closure portion responsive to fluid pressure differential at opposite sides of said wall to move to opened and closed positions.

10. A control device for an internal combustion engine having a spark ignition system, a vacuum source, and a vacuum operated device, comprising: a housing including an inlet port adapted for connection to a vacuum source and an outlet port adapted for connection to a vacuum operated device, a wall in said housing forming chambers at opposite sides communicating with said inlet and outlet ports, respectively, a valve seat formed in said wall, motor means responsive to energization of said spark ignition system to close said valve seat and responsive to de-energization to open said valve seat, a one-way valve in said wall between said chambers permitting fluid flow from said outlet port to said inlet port in the presence of vacuum pressure at said inlet port and preventing fluid flow in the opposite direction through said valve means, the chamber communicating with said inlet port is formed by a pair of sub-chambers communicating with each other and wherein said valve seat is formed in one of said sub-chambers and said one-way valve is formed in the other of said sub-chambers, said valve seat remaining closed during energization of said spark ignition system to isolate said outlet port from said inlet port and maintain vacuum pressure at said vacuum operated device once the latter has been actuated.

11. The control device of claim 10, wherein said wall in said housing is formed by a disc-shaped member, said sub-chambers extending to one side of said disc-shaped member and wherein said outlet member and associated chamber is formed by a cover member attached in sealing relationship with the other side of said disc-shaped member.

12. An air induction system for an internal combustion engine comprising: an air induction passage, a choke valve movable between open and closed positions in said passage, a vacuum break device operatively connected to said choke valve and being respective to vacuum pressure upon starting of an engine to move and maintain said choke valve in an open position, and a control device being operative to maintain vacuum pressure in said vacuum break and said choke valve in an open position in response to actuation of ignition system of an internal combustion engine independently of variations in vacuum pressure at said vacuum source, said control device having a housing including an inlet port connected to said air induction passage downstream of said choke valve and an outlet port connected to said vacuum break device, a wall in said housing forming chambers at opposite sides communicating with said inlet and outlet ports, respectively, a valve seat formed in said wall, motor means responsive to energization of said spark ignition system to close said valve seat and responsive to de-energization to open said valve seat, a one-way valve in said wall between said chambers permitting fluid flow from said outlet port to said inlet port in the presence of vacuum pressure at said inlet port and preventing fluid flow in the opposite direction through said valve means, said valve seat remaining closed upon actuation of the ignition system of said engine to isolate said outlet port from said inlet port and maintain vacuum pressure at said vacuum operated device once the latter has been actuated.

* * * * *